US008899738B2

(12) United States Patent
LeFevre et al.

(10) Patent No.: US 8,899,738 B2
(45) Date of Patent: Dec. 2, 2014

(54) PRESSURE ROLLER CONTAINING A VOLUME OF FLUID

(71) Applicant: Xerox Corporation, Norwalk, CT (US)

(72) Inventors: Jason M. LeFevre, Penfield, NY (US); Paul M. Fromm, Rochester, NY (US); Roger G. Leighton, Hilton, NY (US); David P. VanBortel, Victor, NY (US); Palghat S. Ramesh, Pittsford, NY (US); Bruce E. Thayer, Spencerport, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 25 days.

(21) Appl. No.: 13/746,093

(22) Filed: Jan. 21, 2013

(65) Prior Publication Data

US 2014/0204157 A1 Jul. 24, 2014

(51) Int. Cl.

| | |
|---|---|
| ***B41J 2/01*** | (2006.01) |
| ***F28F 5/02*** | (2006.01) |
| ***B41J 11/00*** | (2006.01) |
| ***B41J 13/076*** | (2006.01) |

(52) U.S. Cl.

CPC ..... *F28F 5/02* (2013.01); *B41J 11/0015* (2013.01); *B41J 11/002* (2013.01); *B41J 13/076* (2013.01)

USPC ..... 347/102; 347/17; 347/18; 347/99

(58) Field of Classification Search

None

See application file for complete search history.

(56) References Cited

U.S. PATENT DOCUMENTS

| | | | | |
|---|---|---|---|---|
| 799,120 | A * | 9/1905 | Way | 138/38 |
| 1,691,979 | A * | 11/1928 | Lochen | 138/38 |
| 2,068,779 | A * | 1/1937 | Tunley et al. | 165/89 |
| 2,262,530 | A * | 11/1941 | Hamlink | 138/38 |
| 3,058,731 | A * | 10/1962 | Bloom | 165/90 |
| 3,633,663 | A * | 1/1972 | Tafel | 165/89 |
| 4,443,389 | A * | 4/1984 | Dodds | 261/153 |
| 4,598,448 | A | 7/1986 | Schiel et al. | |
| 4,794,980 | A * | 1/1989 | Raisanen | 165/54 |
| 5,208,955 | A * | 5/1993 | Schiel | 492/12 |
| 5,426,495 | A | 6/1995 | Sawamura et al. | |
| 5,689,767 | A | 11/1997 | Domoto et al. | |
| 6,571,080 | B2 | 5/2003 | Lee et al. | |
| 6,584,294 | B1 | 6/2003 | Landa et al. | |
| 6,905,119 | B2 | 6/2005 | Guddanti et al. | |
| 7,092,667 | B1 | 8/2006 | Landa et al. | |
| 7,327,978 | B2 | 2/2008 | de Jong et al. | |
| 2002/0141795 | A1 | 10/2002 | Hirst et al. | |
| 2011/0030927 | A1 * | 2/2011 | Okano et al. | 165/104.33 |
| 2011/0149001 | A1 * | 6/2011 | Chappell et al. | 347/103 |
| 2012/0247355 | A1 | 10/2012 | Berniard et al. | |

* cited by examiner

*Primary Examiner* — Justin Seo

(74) *Attorney, Agent, or Firm* — Maginot Moore & Beck LLP

(57) ABSTRACT

A pressure roller for a media processing device has enhanced temperature uniformity and resists temperature increases when subjected to elevated temperatures, enabling greater dimensional stability of the pressure roller in fluctuating temperatures. The pressure roller includes a hollow cylindrical member, an elastomeric layer, and an endbell on each end of the hollow cylindrical member. A chamber is defined by an inner wall of the hollow cylindrical member and the endbells in which a volume of fluid is contained to absorb heat from the hollow cylindrical member.

17 Claims, 6 Drawing Sheets

PRESSURE ROLLER CONTAINING A VOLUME OF FLUID

TECHNICAL FIELD

This disclosure relates generally to pressure rollers for imaging devices, and, in particular, to pressure rollers configured to reduce wrinkling in media.

BACKGROUND

In general, inkjet printing machines or printers include at least one printhead that ejects drops or jets of liquid ink onto a recording or image forming surface. A phase-change inkjet printer employs phase change inks that are solid at ambient temperature, but transition to a liquid phase at an elevated temperature. The melted ink can then be ejected onto print media or an image receiving member by a printhead in response to firing signals received from a controller.

In a direct-to-media printer, the printheads eject ink drops directly onto print media, for example, paper sheets or a continuous media web. After ink drops are printed on the print media, the printer moves the print media through a nip formed between two rollers that apply pressure and, optionally, heat to the ink drops and print medium. One roller, typically referred to as a "spreader roller," contacts the printed side of the print media. The second roller, typically referred to as a "pressure roller," presses the media against the spreader roller to spread the ink drops and fix the ink to the print media.

Pressure rollers typically include a steel cylindrical core coated by an elastomeric layer. During long substantially continuous printing, the temperature of the pressure roller can become elevated due to contact with the heated spreader roller and the print media, which is also heated prior to spreading. Temperature differences along the axial length of the steel core can cause the pressure roller to expand in some locations along the axis of the core, particularly near the center. Non-uniform expansion of the roller alters the shape of the contact the pressure roller makes with the spreader roller, also known as the "nip profile." Changes in the nip profile can result in the print media wrinkling while traveling through the nip, particularly in continuous media printers. Wrinkling of the print media through the spreader can result in image defects in the printed product.

Temperature increases in the pressure roller caused by its use to help spread ink on the media also alters the properties of the elastomeric layer on the roller. For example, in some pressure rollers, increased heating can cause a reduction in the modulus of elasticity of the elastomeric layer. A decreased modulus of elasticity can further impact the nip profile, compounding the media wrinkle issues noted above. Therefore, improvements in the temperature resistance and uniformity of pressure rollers are desirable.

SUMMARY

In one embodiment, a pressure roller for a media processing device has enhanced temperature uniformity and resists temperature increases when subjected to elevated temperatures, enabling greater dimensional stability of the pressure roller in fluctuating temperatures. The pressure roller comprises a hollow cylindrical member, an elastomeric layer, a first endbell, a second endbell, and a volume of fluid. The hollow cylindrical member includes a first end, a second end, an inner cylindrical wall, and an outer cylindrical wall. The inner cylindrical wall forms a chamber that extends between diametrically opposed portions of the inner cylindrical wall around an entire circumference of the inner cylindrical wall and that extends from the first end to the second end of the hollow cylindrical member. The elastomeric layer is positioned immediately adjacent to the outer cylindrical wall and surrounds the outer cylindrical wall from the first end to the second end of the hollow cylindrical member. The elastomeric layer defines an outer surface of the pressure roller. The first endbell is sealingly connected to the first end of the hollow cylindrical member, and the second endbell is sealingly connected to the second end of the hollow cylindrical member. The volume of a fluid is located within the chamber, and fills no more than ninety-five percent of the chamber. The fluid absorbs heat transferred to the hollow cylindrical member by another roller forming a nip with the hollow cylindrical member and distributes the heat absorbed by the hollow cylindrical member throughout the fluid as the hollow cylindrical member rotates to enable uniform thermal expansion of the hollow cylindrical member in the nip.

In another embodiment, a pressure roller for a media processing device has enhanced temperature uniformity and resists temperature increases when subjected to elevated temperatures, enabling greater dimensional stability of the pressure roller in fluctuating temperatures. The pressure roller comprises a hollow cylindrical member, an elastomeric layer, a first endbell, a second endbell, a solid rod, and a volume of fluid. The hollow cylindrical member includes a first end, a second end, an inner cylindrical wall, and an outer cylindrical wall. The inner cylindrical wall forms a chamber that extends between diametrically opposed portions of the inner cylindrical wall around an entire circumference of the inner cylindrical wall and that extends from the first end to the second end of the hollow cylindrical member. The elastomeric layer is positioned immediately adjacent to the outer cylindrical wall and surrounds the outer cylindrical wall from the first end to the second end of the hollow cylindrical member. The elastomeric layer defines an outer surface of the pressure roller. The first endbell is sealingly connected to the first end of the hollow cylindrical member, and the second endbell is sealingly connected to the second end of the hollow cylindrical member. The solid rod extends axially through the center of the hollow cylindrical member from the first endbell to the second endbell. The volume of a fluid is located within the chamber, and fills no more than ninety-five percent of the chamber. The fluid absorbs heat transferred to the hollow cylindrical member by another roller forming a nip with the hollow cylindrical member and distributes the heat absorbed by the hollow cylindrical member throughout the fluid as the hollow cylindrical member rotates to enable uniform thermal expansion of the hollow cylindrical member in the nip.

In yet another embodiment, a printing machine includes a pressure roller that has enhanced temperature uniformity and resists temperature increases when subjected to elevated temperatures, enabling greater dimensional stability of the pressure roller in fluctuating temperatures. The printing machine comprises a first roller, a second roller, a plurality of printheads, and a media transport. The second roller includes a hollow cylindrical member, an elastomeric layer, a first endbell, a second endbell, and a volume of fluid. The hollow cylindrical member has a first end, a second end, an inner cylindrical wall, and an outer cylindrical wall. The inner cylindrical wall forms a chamber that extends between diametrically opposed portions of the inner cylindrical wall around an entire circumference of the inner cylindrical wall and that extends from the first end to the second end of the hollow cylindrical member. The elastomeric layer of the second roller is positioned immediately adjacent to the outer cylindrical wall of the hollow cylindrical member and surrounds the outer cylindrical wall from the first end to the second end of the hollow cylindrical member. The first endbell is sealingly connected to the first end of the hollow cylindrical member, and the second endbell is sealingly connected to the second end of the hollow cylindrical member. The volume of a fluid is located within the chamber, and fills no more than ninety-five percent of the chamber. The fluid absorbs heat transferred to the hollow cylindrical member by the first roller, which forms a nip with the hollow cylindrical member of the second roller, and distributes the heat absorbed by the hollow cylindrical member throughout the fluid as the hollow cylindrical member rotates to enable uniform thermal expansion of the hollow cylindrical member in the nip. The plurality of printheads are configured to eject ink drops onto a media web, which is subsequently moved through the nip by the media transport to spread the ink drops and form an ink image on the media web.

DETAILED DESCRIPTION

Figure 1:
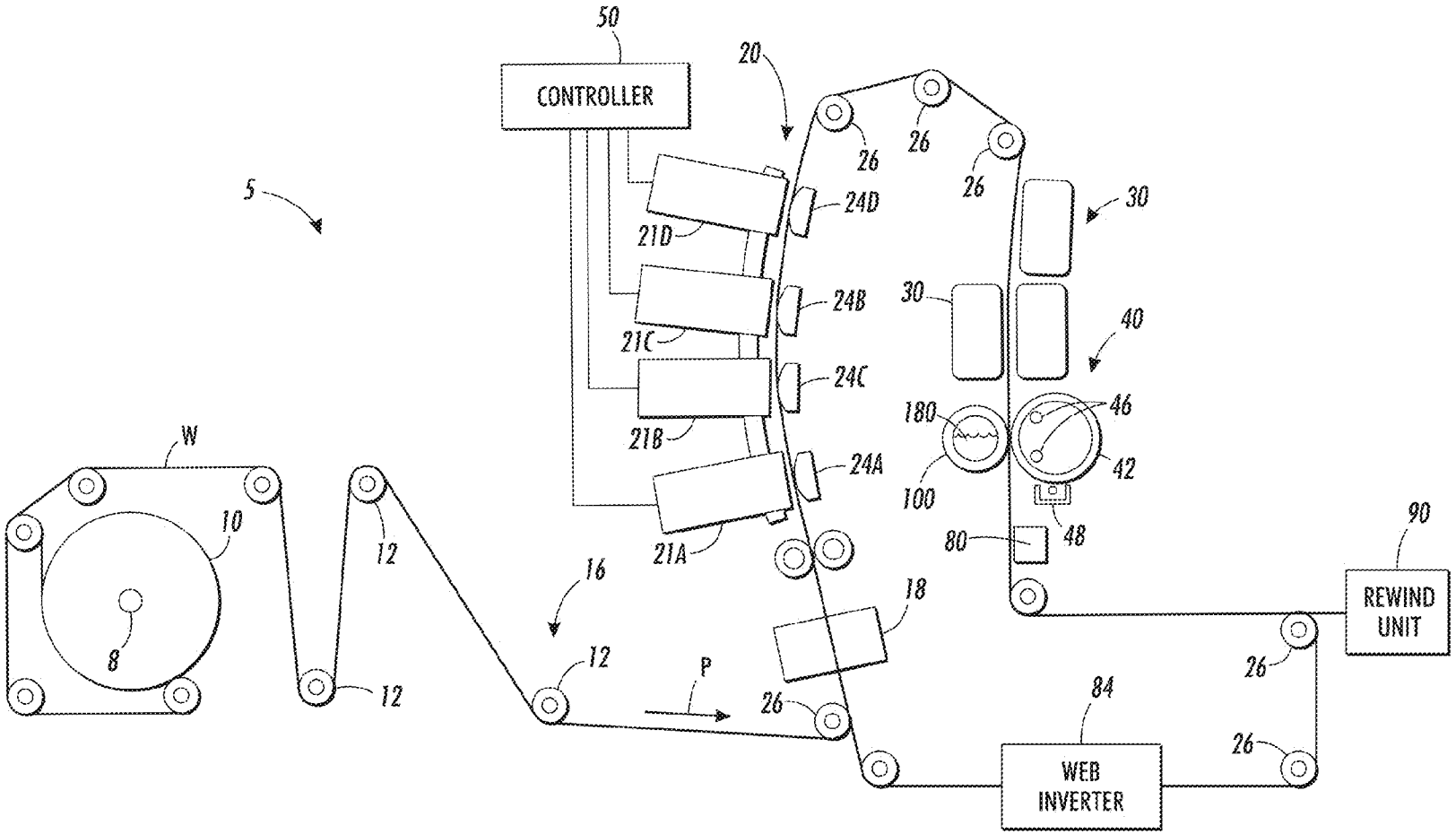
FIG. 1 is a schematic drawing of a continuous feed direct to media printer including a fluid-containing pressure roller.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Phase-change ink printers use phase-change ink, also referred to as a solid ink, which is in a solid state at room temperature but melts into a liquid state at a higher operating temperature. The liquid ink drops are printed onto an image receiving surface in either a direct or indirect printer.

As used herein, the term "media processing device" refers to a device that is configured to perform processing operations on a substrate, such as paper, either in web or cut-sheet form. The media processing device can be, for example, a printing device, a laminating machine, or any other device through which media substrate is transported using rollers and/or belts.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

In a direct-to-media printer, the printheads eject ink drops directly onto a print media, for example, a paper sheet or a continuous media web. After ink drops are printed on the print media, the printer moves the print media through a nip formed between two rollers that apply pressure and, optionally, heat to the ink drops and print media. One roller, typically referred to as a "spreader roller" contacts the printed side of the print medium. The second roller, typically referred to as a "pressure roller," presses the media against the spreader roller to spread the ink drops and fix the ink to the print media. In indirect printers, the printheads eject ink drops onto an intermediate member surface, such as the surface of a rotating drum or belt, and the resulting ink image is passed through a nip formed between the rotating surface and a pressure roller, which is sometimes referred to as a "transfix" or "transfer" roller, in synchronization with print media. The pressure and sometimes heat in the nip transfer the ink image from the intermediate member surface to the media, which is subsequently treated at additional heating and spreading stations to further fix the ink image to the print media.

FIG. 1 depicts a schematic view of an inkjet printer 5 having a fluid-containing pressure roller 100. For the purposes of this disclosure, an inkjet printer employs one or more inkjet printheads to eject drops of ink into an image receiving member, such as paper, another type of print media, or an indirect member such as a rotating image drum or belt. The printer 5 is configured to print ink images with a "phase-change ink," by which is meant an ink that is substantially solid at room temperature and that transitions to a liquid state when heated to a phase change ink melting temperature for jetting onto the imaging receiving member surface. In other embodiments, the ink utilized in the printer comprises UV curable gel inks, which are also heated before being ejected by the inkjet ejectors of the printhead. As used herein, liquid ink refers to melted phase change ink, heated gel ink, or other forms of ink, such as aqueous inks, ink emulsions, ink suspensions, ink solutions, or the like.

The printer 5 includes a controller 50 to process the image data before generating the control signals for the inkjet ejectors to eject colorants. Colorants can be ink or any suitable substance that includes one or more dyes or pigments and that is applied to the selected media. The colorant can be black, or any other desired color, and some printer configurations apply a plurality of distinct colorants to the media. In the configuration of FIG. 1, the printer 5 ejects cyan, magenta, yellow, and black (CMYK) inks onto the media web to form color ink images. The media includes any of a variety of substrates, including plain paper, coated paper, glossy paper, or transparencies, among others, and the media can be available in sheets, rolls, or other physical formats.

The printer 5 is an example of a direct-to-sheet, continuous-media, phase-change inkjet printer that includes a media supply and handling system configured to supply a long, substantially continuous, web of media W of "substrate" (paper, plastic, or other printable material) from a media source, such as spool of media 10 mounted on a web roller 8. For simplex printing, the printer 5 passes the media web W through a media conditioner 16, print zone 20, printed web conditioner 80, and rewind unit 90 once. In the simplex operation, the media source 10 has a width that substantially covers the width of the rollers over which the media travels through the printer.

For duplex operations, the web inverter 84 turns the media web W over to present a second side of the media to the printhead units 21A to 21D forming print zone 20 and to the printed web conditioner 80, before the media is taken up by the rewind unit 90. In a duplex operation, the web travels over about one-half of the longitudinal length of each roller 26 in the print zone 20 and printed web conditioner 80. The inverter 84 flips and laterally displaces the media web W so the media web W subsequently travels over the other half of the longitudinal length of each roller 26 through the print zone 20 and printed web conditioner 80 to print and condition the reverse side of the media web W. The rewind unit 90 is configured to wind the web onto a roller for removal from the printer and subsequent processing.

In another duplex printing configuration, two printers with the configuration of the printer 5 are arranged serially with a web inverter interposed between the two printers to perform duplex printing operations. In the serial printing arrangement, the first printer forms and fixes an image on one side of a web, the inverter turns the web over, and the second printer forms and fixes an image on the second side of the web. In the serial duplex printing configuration, the width of the media web W can substantially cover the longitudinal length of the rollers in both printers over which the media travels during duplex printing.

The media web W is unwound from the source 10 as needed and a variety of motors, not shown, rotate one or more rollers 12 and 26 to propel the media web W. The media conditioner includes rollers 12 and a pre-heater 18. The rollers 12 and 26 control the tension of the unwinding media as the media moves along a path through the printer. In alternative embodiments, the printer transports a cut sheet media through the print zone, in which case the media supply and handling system includes any suitable device or structure to enable the transport of cut media sheets along a desired path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature.

The media is transported through a print zone 20 that includes a series of color printhead modules or units 21A, 21B, 21C, and 21D, each printhead unit effectively extends across the width of the media and is able to eject ink directly onto the moving media. In printer 5, each of the printheads ejects a single color of ink, one for each of the colors typically used in color printing, namely, cyan, magenta, yellow, and black (CMYK) for printhead units 21A, 21B, 21C, and 21D, respectively. The controller 50 of the printer receives velocity data from encoders mounted proximately to rollers positioned on either side of the portion of the path opposite the four printheads to calculate the linear velocity and position of the web as the web moves past the printhead units. The controller 50 uses these data to generate firing signals for actuating the inkjet ejectors in the printhead arranged in the printhead units to enable the printheads to eject four colors of ink with appropriate timing and accuracy for registration of the differently colored patterns to form color images on the media. The inkjet ejectors actuated by the firing signals correspond to digital data processed by the controller 50, which can be transmitted to the printer, generated by a scanner (not shown) that is a component of the printer, or otherwise generated and delivered to the printer. In various configurations, a color module for each primary color includes one or more printheads, multiple printheads in a module are formed into a single row or multiple row array, printheads of a multiple row array are staggered, a printhead prints more than one color, or the printheads or portions thereof are mounted movably in a direction transverse to the process direction P for printing operations. While the printhead units in the printer 5 are configured to eject liquid drops of a phase change ink onto the media web W, a similar configuration of inkjets that print solvent inks, aqueous inks, or any other liquid ink can be used to generate color ink images as described herein.

A backing member 24A-24D, typically in the form of a bar or roll, is associated with each color module and is arranged substantially opposite the printhead units on the back side of the media. Each backing member positions the media at a predetermined distance from the printheads in the printhead unit opposite the backing member. The backing members 24A-24D are optionally configured to emit thermal energy to heat the media to a predetermined temperature, and the various backer members can be controlled individually or collectively. The pre-heater 18, the printheads, backing members 24A-24D (if heated), as well as the surrounding air combine to maintain the media along the portion of the path opposite the print zone 20 in a predetermined temperature range that is suitable for the media to receive ejected ink from the printheads.

As the partially-imaged media web W moves to receive inks of various colors from the printheads of the print zone 20, the printer 5 maintains the temperature of the media web within a predetermined range. The printheads in the color modules 21A-21D eject ink at a temperature typically significantly higher than the temperature of the media web W. Consequently, the ink heats the media, and the printer 5 includes temperature control devices to maintain the media web temperature within the predetermined range. For example, air blowers or fans can be utilized to facilitate control of the media temperature. Thus, the printer 5 maintains the temperature of the media web W within an appropriate range for the jetting of all inks from the printheads of the print zone 20. Temperature sensors (not shown) can be positioned along this portion of the media path to enable regulation of the media temperature.

Following the print zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature results in less line spread while higher ink temperature causes the ink image to be visible from the non-printed side of the media. In one embodiment, the mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly includes any suitable device or apparatus for fixing images to the media including heated or unheated pressure rollers, radiant heaters, heat lamps, and the like. In the embodiment of the FIG. 7, the fixing assembly 40 includes a spreader roller 42 and a pressure roller 100, which apply a predetermined pressure, and in some implementations, heat, to the media. The function of the fixing assembly 40 is to flatten the individual ink droplets, strings of ink droplets, or lines of ink on web W with pressure and, in some systems, heat. The fixing assembly 40 flattens the ink drops to fill spaces between adjacent drops and improve the uniformity of the images on the media web W. In addition to spreading the ink, the fixing assembly 40 improves fixation of the ink image to the media web W by increasing ink layer cohesion and/or increasing the ink-web adhesion. The spreader roller 42 can include heat elements, such as heating elements 46, to bring the web W to a temperature in a range from about 35° C. to about 80° C.

In one practical embodiment, the spreader roller 42 in fixing assembly 40 is maintained at an optimum temperature that depends on the properties of the ink, for example, 55° C. Generally, a lower roller temperature gives less line spread while a higher temperature can produce imperfections in the gloss of the ink image. Roller temperatures that are too high may cause ink to offset to the roller. In one practical embodiment, the pressure roller 100 is pressed into the spreader roller 42 with a force of approximately 3000 pounds at each end of the pressure roller 100. As described in detail below, the pressure roller 100 of the fixing assembly 40 is partially filled with a fluid 180 to increase the temperature uniformity of the pressure roller 100.

The fixing assembly 40 can include a cleaning/oiling station 48 associated with the spreader roller 42. The station 48 cleans and/or applies a layer of some release agent or other material to the surface of the spreader roller 42 to disable the ink from adhering to the surface of the spreader roller 42.

Following passage through the spreader 40 the printed media can be directed to the web inverter 84 for inversion of the print medium and displacement to another section of the rollers for a second pass by the printheads, mid-heaters, spreader, and coating station. Alternatively, the media web W can be wound onto a roller for removal from the system after a simplex printing operation or after printing the second side of a duplex operation. One configuration of the printer 5 winds the simplex or duplex printed media onto a roller for removal from the system by rewind unit 90. Alternatively, the media can be directed to other processing stations that perform tasks such as cutting, binding, collating, and/or stapling the media or the like.

While the embodiment of FIG. 1 illustrates a direct-to-media continuous feed printer, the reader should appreciate that the pressure roller containing fluid can be used in other types of printers as well. For example, the fluid-containing pressure roller can be used in an indirect printer or in a cut-sheet imaging device. Furthermore, the fluid-containing pressure roller described herein can be used in other media processing devices that transport heated media through a nip, for example, a high pressure laminating device.

Figure 2:
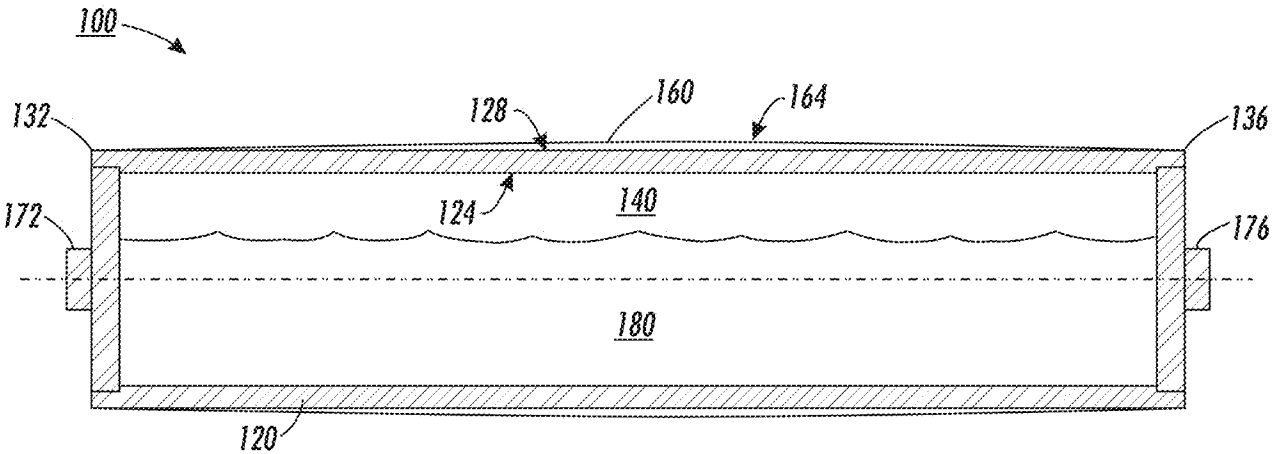
FIG. 2 is a cross-sectional view of the fluid-containing pressure roller of the printer of FIG. 1.

FIG. 2 depicts a cross-sectional view of the pressure roller 100 of the printer 5. The pressure roller 100 includes a hollow cylindrical member 120, an elastomeric layer 160, a first endbell 172, and a second endbell 176. A chamber 140 is defined within the hollow cylindrical member 120 between the first 172 and second 176 endbells. The chamber 140 is configured to store a predetermined quantity of fluid 180, which absorbs heat from the hollow cylindrical member 120.

The hollow cylindrical member 120 defines an inner wall 124, an outer wall 128, a first end 132, and a second end 136. The first 132 and second 136 ends of the hollow cylindrical member 120 are configured to accommodate the first endbell 172 and second endbell 176, respectively, which can be welded or otherwise sealingly connected to the inner wall 124 of the hollow cylindrical member 120. In one embodiment, the hollow cylindrical member 120 and endbells 172 and 176 substantially comprise stainless steel, for example, type 304 stainless steel, though other suitable materials can be used in different embodiments.

The inner wall 124 of the hollow cylindrical member 120 and the endbells 172 and 176 define the chamber 140. In the embodiment of FIG. 2, the chamber 140 is cylindrical, extending from a portion of the inner wall 124 to a diametrically opposed portion of the inner wall 124 around the entire circumference of the inner wall 124. In other words, the chamber 140 is cylindrical and includes no elements positioned within the chamber 140.

The chamber 140 is configured to be partially filled with a fluid 180, which can be water, antifreeze, or another suitable liquid. One or both of the endbells 172 and 176 can include a plug (not shown) to enable filling and emptying of the fluid 180 in the chamber 140. In one embodiment, the chamber 140 is configured to be filled with approximately one and a half gallons (5.7 liters) of fluid 180, though the amount of fluid in the chamber can vary depending on the size and the desired thermal characteristics of the pressure roller.

The elastomeric layer 160 coats the outer wall 128 of the hollow cylindrical member 120. The elastomeric layer 160 includes an outer surface 164 that is configured to contact a spreader roller, such as spreader roller 42 of FIG. 1, to form a pressure nip through which the media web is transported to spread and fix ink to the media web. The elastomeric layer 160 has a first thickness at the first 132 and second 136 ends of the hollow cylindrical member 120, and a second thickness at the center of the hollow cylindrical member 120. The thickness at the center of the hollow cylindrical member 120 is typically greater than the thickness at the ends 132 and 136 to enable the outer surface 164 of the elastomeric layer 160 to have a crowned profile. In one embodiment, the elastomeric layer 160 substantially comprises polyurethane with a thickness of 2.5 millimeters in the center and 2.475 millimeters at the ends 132 and 136 of the roller. In other embodiments, the elastomeric layer can comprise other suitable materials, such as nitrile butadiene rubber ("NBR"), and can be formed with a different thickness.

In operation, the pressure roller 100 is mounted in a printer, such as printer 5, and configured to form a nip with a spreader roller, such as spreader roller 42. A media web, on which an ink image has been formed, is fed through the nip formed between the spreader roller and the pressure roller 100. The media web is heated and the ink image on the media web includes a plurality of heated ink drops, both of which result in heat transferring to the pressure roller 100. The heat from the ink and media web is absorbed by the elastomeric layer 160 and the hollow cylindrical member 120.

In a pressure roller that does not contain fluid, the absorbed heat can cause the temperature of the pressure roller to increase, particularly near the center of the roller. As the temperature of the roller increases, the roller develops thermal gradients, resulting in portions of the pressure roller expanding and changing the shape of the roller. The change in the roller shape alters the ability of the nip formed between the pressure roller and the spreader roller to pass media without wrinkling. In particular, the center of the roller tends to expand, causing the pressure roller to develop a barrel shape.

Axial velocity differentials in the nip form as a result of creep energy caused by the non-uniform thermal expansion of the pressure roller, which can produce wrinkling of the media as it passes through the nip. The media wrinkle problems are exacerbated in the context of solid ink printing, as the solid ink can adhere to the pressure roller, reducing the coefficient of friction between the media and the pressure roller. The reduced friction between the pressure roller and media in combination with the velocity differentials in the nip wrinkles the media in the nip.

Furthermore, increased temperature in the pressure roller can reduce the modulus of the elastomeric layer. In response to the reduced modulus, less pressure is generated in the nip between the pressure roller and the spreader roller, further reducing the force that holds the media against the pressure roller as it moves through the nip. The reduced pressure at the nip enables the creep forces generated by velocity differentials to have a greater effect on the media, compounding media wrinkle problems.

As pressure roller 100 contacts heated media moving through the nip, heat is transferred from the media to the elastomeric layer 160 and the hollow cylindrical member 120. The fluid 180 in pressure roller 100 is configured to absorb the heat from the hollow cylindrical member 120 and elastomeric layer 160. The volumetric heat capacity of the fluid 180 is significantly greater than that of the hollow cylindrical member 120, resulting in an increased overall heat capacity of the pressure roller 100. The pressure roller 100 is therefore able to resist increases in temperature of the pressure roller 100 during printing processes, which minimizes the thermal effects on the modulus of the elastomeric layer 160 and reduces thermal expansion of the hollow cylindrical member 120.

Furthermore, as the media is fed through the nip between the pressure roller 100 and the spreader roller, the pressure roller 100 rotates about a center axis, which agitates the fluid 180 inside the chamber 140. As the fluid 180 moves within the chamber 140, the heated portions of the fluid 180 are mixed along the axis of the hollow cylindrical member 120 with cooler portions of the fluid 180. Thus, the fluid 180 remains at a relatively uniform temperature along the axis of the hollow cylindrical member 120. Because the heat capacity of the fluid 180 is greater than the heat capacity of the hollow cylindrical member 120, the temperature of the hollow cylindrical member 120 remains near the temperature of the fluid 180 along the entire axial length of the hollow cylindrical member 120, enhancing the temperature uniformity of the hollow cylindrical member 120. Thermal expansion of the hollow cylindrical member 120 is therefore uniform along the axial length of the hollow cylindrical member 120, which enables the nip profile to be unaffected by temperature increases of the hollow cylindrical member 120. This uniform thermal expansion enables the nip to retain a profile that reduces media wrinkle, for example, a "zero-crown" profile, which pulls the media web toward the ends 132 and 136 of the pressure roller 100 to prevent the media from wrinkling in the nip.

Figure 3:
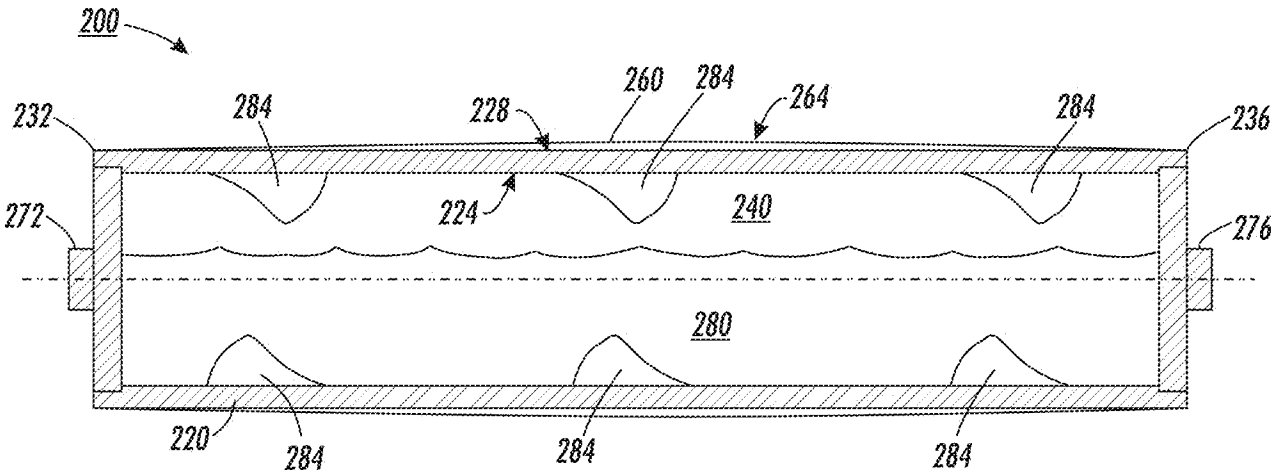
FIG. 3 is a cross-sectional view of a fluid-containing pressure roller having internal fins.

FIG. 3 depicts a cross-sectional view of another embodiment of a pressure roller 200. The pressure roller 200 includes a hollow cylindrical member 220, an elastomeric layer 260, a first endbell 272, and a second endbell 276. A chamber 240 is defined within the hollow cylindrical member 240 between the first 272 and second 276 endbells. The chamber 240 is configured to store a predetermined quantity of fluid 280, which absorbs heat from the hollow cylindrical member 220.

The hollow cylindrical member 220 defines an inner wall 224, an outer wall 228, a first end 232, and a second end 236. The first 232 and second 236 ends of the hollow cylindrical member 220 are configured such that the first endbell 272 and second endbell 276 are sealingly connected to the inner wall 224 of the hollow cylindrical member 220 at the ends 232 and 236, respectively. The inner wall 224 includes a plurality of fins 284 that project from the inner wall 224 and are spaced within the chamber 240 circumferentially and axially. The fins 284 are configured to increase the mixing of the fluid 280 in the chamber 240 as the pressure roller 200 rotates.

The inner wall 224 of the hollow cylindrical member 220 and the endbells 272 and 276 define the chamber 240. The chamber 240 is cylindrical, with the exception of the fins 284 projecting from the inner wall 224. The chamber 240 is configured to be partially filled with a fluid 280 to absorb and spread heat from the hollow cylindrical member 220.

The elastomeric layer 260 coats the outer wall 228 of the hollow cylindrical member 220. The elastomeric layer 260 includes an outer surface 264 that is configured to contact a spreader roller to form a pressure nip through which the media web is transported to spread and fix ink to the media web. The elastomeric layer 260 has a first thickness at the first 232 and second 236 ends of the hollow cylindrical member 220, and a second thickness in the center of the hollow cylindrical member 220. The elastomeric layer 260 has a crowned profile, meaning that the elastomeric layer 260 is thicker at the center of the roller 200 than at the ends 232 and 236 of the roller 200.

The pressure roller 200 operates in substantially the same manner as the pressure roller 100 described above with reference to FIG. 1 and FIG. 2. However, as the pressure roller 200 rotates about the center axis, the fins 284 supplement the agitation of the fluid 280 inside the chamber 240. Agitating the fluid 280 with fins 284 further mixes the fluid 280 and spreads the heat absorbed throughout the volume of fluid 280, enabling enhanced temperature uniformity throughout the hollow cylindrical member 220 and elastomeric layer 260.

Figure 4:
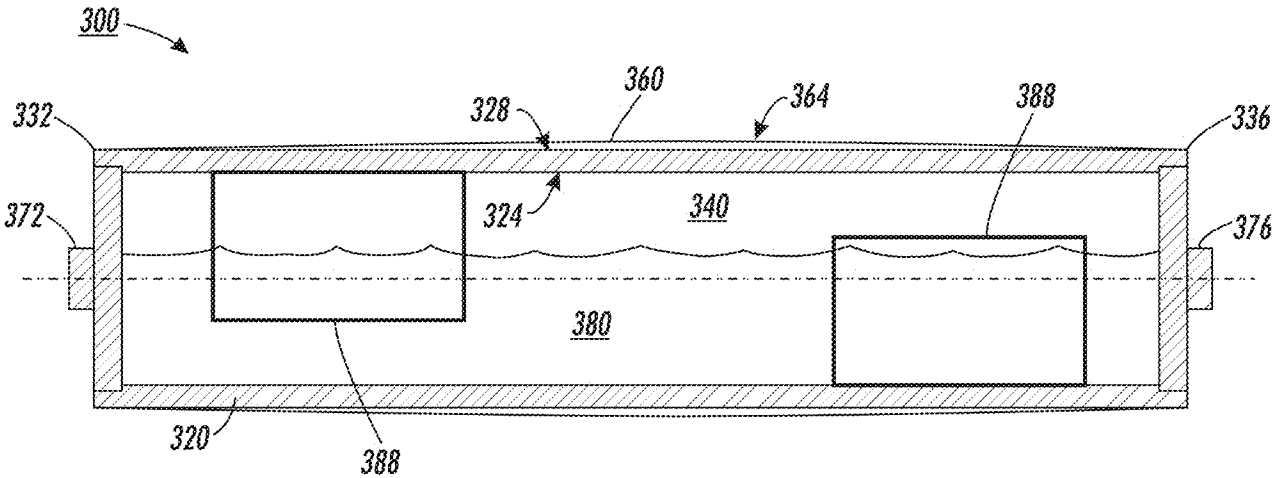
FIG. 4 is a cross-sectional view of a fluid-containing pressure roller having internal paddles.

FIG. 4 depicts a cross-sectional view of another embodiment of a pressure roller 300. The pressure roller 300 includes a hollow cylindrical member 320, an elastomeric layer 360, a first endbell 372, and a second endbell 376. A chamber 340 is defined within the hollow cylindrical member 340 between the first 372 and second 376 endbells. The chamber 340 is configured to store a predetermined quantity of fluid 380, which absorbs heat from the hollow cylindrical member 320.

The hollow cylindrical member 320 defines an inner wall 324, an outer wall 328, a first end 332, and a second end 336. The first 332 and second 336 ends of the hollow cylindrical member 320 are configured such that the first endbell 372 and second endbell 376 are sealingly connected to the inner wall 324 of the hollow cylindrical member 320 at the ends 332 and 336, respectively. The inner wall 324 includes a plurality of paddles 388 projecting from the inner wall 324, which are spaced at different positions along the circumference of the inner wall of the chamber and extend axially along the inner wall of the chamber 340. The paddles could also be spaced at different positions along the axial length of the inner wall of the chamber and extend circumferentially along a portion of the inner wall of the chamber 340. The paddles 388 are configured to increase the mixing of the fluid 380 in the chamber 340 as the pressure roller 300 rotates.

The inner wall 324 of the hollow cylindrical member 320 and the endbells 372 and 376 define the chamber 340. The chamber 340 is cylindrical, with the exception of the paddles 388 projecting from the inner wall 324. The chamber 340 is configured to be partially filled with a fluid 380 that absorbs heat from the hollow cylindrical member 320.

The elastomeric layer 360 coats the outer wall 328 of the hollow cylindrical member 320. The elastomeric layer 360 includes an outer surface 364 that is configured to contact a spreader roller to form a pressure nip through which the media web is transported to spread and fix ink to the media web. The elastomeric layer 360 has a crowned profile, meaning that the elastomeric layer 360 is thicker at the center of the roller 300 than at the ends 332 and 336 of the roller 300.

The pressure roller 300 operates in substantially the same manner as the pressure roller 100 described above with reference to FIG. 1 and FIG. 2. However, as the pressure roller 300 rotates about the center axis, the paddles 388 supplement the agitation of the fluid 380 inside the chamber 340. Agitating the fluid 380 with paddles 388 further mixes the fluid 380 and distributes the heat absorbed throughout the volume of fluid 380, enabling enhanced temperature uniformity throughout the hollow cylindrical member 320 and elastomeric layer 360.

Figure 5:
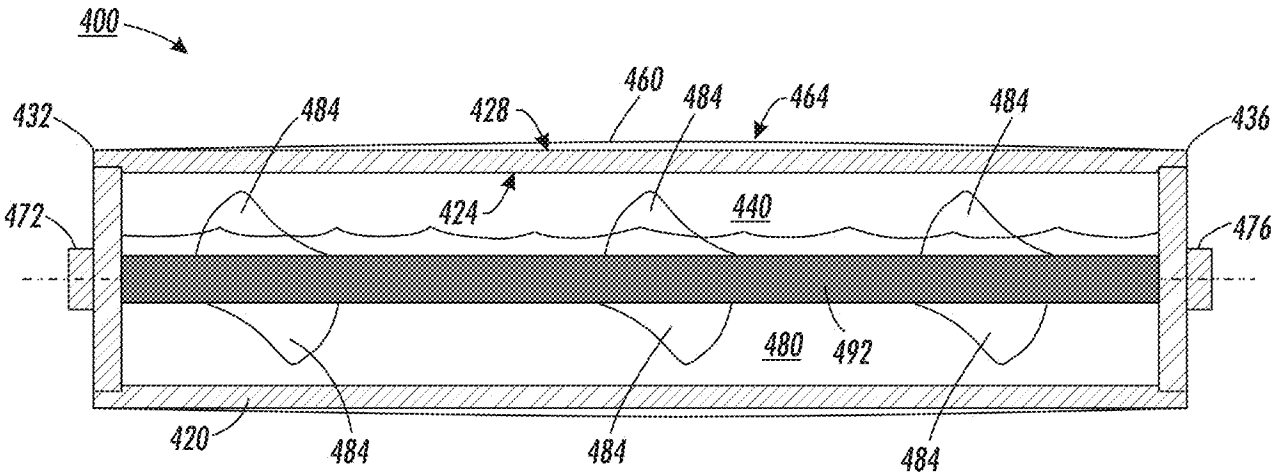
FIG. 5 is a cross-sectional view of a fluid-containing pressure roller having a solid core with fins.

FIG. 5 depicts a cross-sectional view of another pressure roller 400. The pressure roller 400 includes a hollow cylindrical member 420, an elastomeric layer 460, a first endbell 472, a second endbell 476, and a solid rod 492. A chamber 440 is defined within the hollow cylindrical member 440 between the first 472 and second 476 endbells. The chamber 440 is configured to store a predetermined quantity of fluid 480, which absorbs heat from the hollow cylindrical member 420. The solid rod 492 extends axially through the center of the hollow cylindrical member 420 from the first endbell 472 to the second endbell 476 and includes a plurality of fins 484 projecting outwardly from the solid rod 492. The fins 484 are configured to increase the mixing of the fluid 480 in the chamber 440 as the pressure roller 400, including the solid rod 492, rotates.

The hollow cylindrical member 420 defines an inner wall 424, an outer wall 428, a first end 432, and a second end 436. The first 432 and second 436 ends of the hollow cylindrical member 420 are configured such that the first endbell 472 and second endbell 476 are sealingly connected to the inner wall 424 of the hollow cylindrical member 420 at the ends 432 and 436, respectively.

The inner wall 424 of the hollow cylindrical member 420, the endbells 472 and 476, and the outer surface of the solid rod 492 define the chamber 440. The chamber 440 is in the shape of an annular cylinder, with the exception of the fins 484 projecting from the solid rod 492 into the chamber 440. The chamber 440 is configured to be partially filled with a fluid 480 that absorbs heat from the hollow cylindrical member 420.

The elastomeric layer 460 coats the outer wall 428 of the hollow cylindrical member 420. The elastomeric layer 460 includes an outer surface 464 that is configured to contact a spreader roller to form a pressure nip through which the media web is transported to spread and fix ink to the media web. The elastomeric layer 460 has a crowned profile, meaning that the elastomeric layer 460 is thicker at the center of the roller 400 than at the ends 432 and 436 of the roller 400.

The pressure roller 400 operates in substantially the same manner as the pressure roller 100 described above with reference to FIG. 1 and FIG. 2. However, as the pressure roller 400 and solid rod 492 rotate about the center axis, the fins 484 supplement the agitation of the fluid 480 inside the chamber 440. Agitating the fluid 480 with fins 484 further mixes the fluid 480 and spreads the heat absorbed throughout the volume of fluid 480, enabling enhanced temperature uniformity throughout the hollow cylindrical member 420.

Figure 6:
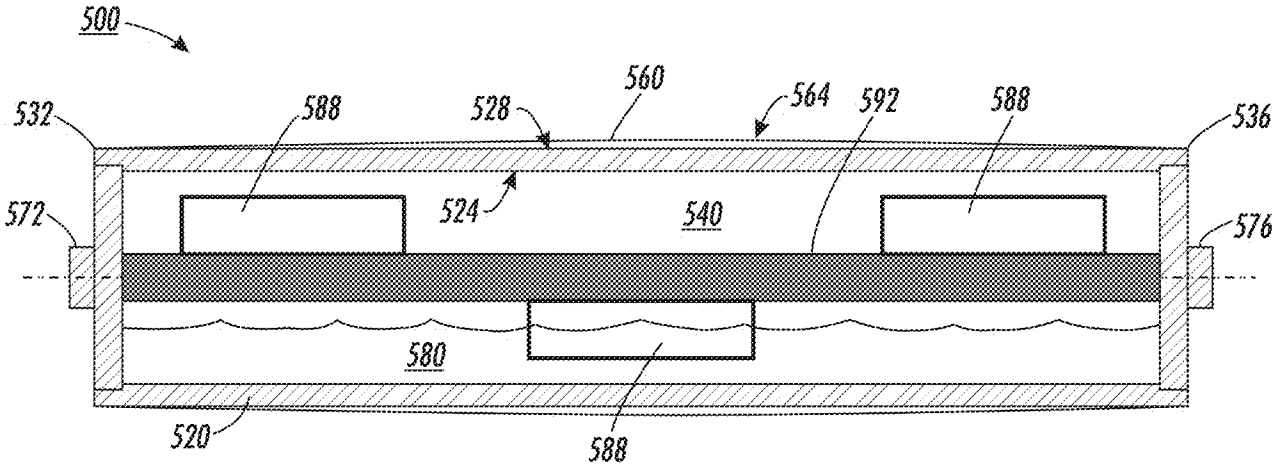
FIG. 6 is a cross-sectional view of a fluid-containing pressure roller having a solid core with paddles.

FIG. 6 depicts a cross-sectional view of another embodiment of a pressure roller 500. The pressure roller 500 includes a hollow cylindrical member 520, an elastomeric layer 560, a first endbell 572, a second endbell 576, and a solid rod 592. A chamber 540 is defined within the hollow cylindrical member 540 between the first 572 and second 576 endbells. The chamber 540 is configured to store a predetermined quantity of fluid 580, which absorbs heat from the hollow cylindrical member 520. The solid rod 592 extends axially through the center of the hollow cylindrical member 520 from the first endbell 572 to the second endbell 576 and includes a plurality of paddles 588 projecting outwardly from the solid rod 592. The paddles 588 are configured to increase the mixing of the fluid 580 in the chamber 540 as the pressure roller 500, including the solid rod 592, rotates.

The hollow cylindrical member 520 defines an inner wall 524, an outer wall 528, a first end 532, and a second end 536. The first 532 and second 536 ends of the hollow cylindrical member 520 are configured such that the first endbell 572 and second endbell 576 are sealingly connected to the inner wall 524 of the hollow cylindrical member 520 at the ends 532 and 536, respectively.

The inner wall 524 of the hollow cylindrical member 520, the endbells 572 and 576, and the outer surface of the solid rod 592 define the chamber 540. The chamber 540 is in the shape of an annular cylinder, with the exception of the paddles 588 projecting from the solid rod 592 into the chamber 540. The paddles 588 can extend in a relatively straight line along a portion of the axial length of the solid rod 592 and extend into the chamber 540 an appropriate distance without touching the inner wall of the chamber 540. Alternatively, the paddles can follow all or a portion of the circumference of the solid rod 592 either in a circular or helical pattern. The chamber 540 is configured to be partially filled with a fluid 580 that absorbs heat from the hollow cylindrical member 520.

The elastomeric layer 560 coats the outer wall 528 of the hollow cylindrical member 520. The elastomeric layer 560 includes an outer surface 564 that is configured to contact a spreader roller to form a pressure nip through which the media web is transported to spread and fix ink on the media web. The elastomeric layer 560 has a crowned profile, meaning that the elastomeric layer 560 is thicker at the center of the roller 500 than at the ends 532 and 536 of the roller 500.

The pressure roller 500 operates in substantially the same manner as the pressure roller 100 described above with reference to FIG. 1 and FIG. 2. However, as the pressure roller 500 and solid rod 592 rotate about the center axis, the paddles 588 supplement the agitation of the fluid 580 inside the chamber 540. Agitating the fluid 580 with paddles 588 further mixes the fluid 580 and spreads the heat absorbed throughout the volume of fluid 580, enabling enhanced temperature uniformity along the axial length of the hollow cylindrical member 520.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A pressure roller for a media processing device comprising:

a hollow cylindrical member having a first end, a second end, an inner cylindrical wall, and an outer cylindrical wall, the inner cylindrical wall forming a chamber that extends between diametrically opposed portions of the inner cylindrical wall around an entire circumference of the inner cylindrical wall and that extends from the first end to the second end of the hollow cylindrical member, the inner cylindrical wall having at least one paddle extending from the inner cylindrical wall;

an elastomeric layer positioned immediately adjacent to the outer cylindrical wall and surrounding the outer cylindrical wall from the first end to the second end of the hollow cylindrical member, the elastomeric layer defining an outer surface of the pressure roller;

a first endbell sealingly connected to the first end of the hollow cylindrical member;

a second endbell sealingly connected to the second end of the hollow cylindrical member, the first endbell and the second endbell preventing ingress and egress of fluid from the chamber within the hollow cylindrical member; and a volume of a fluid within the chamber that fills no more than ninety-five percent of the chamber to absorb heat transferred to the hollow cylindrical member by another roller forming a nip with the hollow cylindrical member, the at least one paddle extending from the inner cylindrical wall being configured to mix the fluid within the chamber to distribute the heat absorbed by the hollow cylindrical member throughout the fluid as the hollow cylindrical member rotates to enable uniform thermal expansion of the hollow cylindrical member in the nip.

2. The pressure roller of claim 1, the inner cylindrical wall of the hollow cylindrical member further comprising:

at least one fin extending from the inner cylindrical wall, the at least one fin being configured to mix the fluid and distribute the heat absorbed by the hollow cylindrical member within the chamber to enable uniform thermal expansion of the hollow cylindrical member in the nip.

3. The pressure roller of claim 1 wherein the hollow cylindrical member is substantially comprised of stainless steel.

4. The pressure roller of claim 1 wherein the elastomeric layer is substantially comprised of polyurethane.

5. The pressure roller of claim 1 wherein an outer diameter of the elastomeric layer at the first and second ends of the hollow cylindrical member is less than an outer diameter of the elastomeric layer at a center portion of the hollow cylindrical member.

6. The pressure roller of claim 1, the outer surface of the elastomeric layer being configured to contact the other roller under pressure to form the nip.

7. A pressure roller for a media processing device comprising:

a hollow cylindrical member having a first end, a second end, an inner cylindrical wall, and an outer cylindrical wall, the inner cylindrical wall forming a chamber that extends between diametrically opposed portions of the inner cylindrical wall around an entire circumference of the inner cylindrical wall and that extends from the first end to the second end of the hollow cylindrical member;

an elastomeric layer positioned immediately adjacent the outer cylindrical wall and surrounding the outer cylindrical wall from the first end to the second end of the hollow cylindrical member, the elastomeric layer defining an outer surface of the pressure roller;

a first endbell sealingly connected to the first end of the hollow cylindrical member;

a second endbell sealingly connected to the second end of the hollow cylindrical member, the first endbell and the second endbell preventing ingress and egress of fluid from the chamber within the hollow cylindrical member;

a solid rod extending axially through the center of the hollow cylindrical member from the first endbell to the second endbell, the solid rod having at least one paddle extending from the outer surface of the solid rod; and a volume of a fluid within the chamber that fills no more than ninety-five percent of the chamber to absorb heat transferred to the hollow cylindrical member by another roller forming a nip with the hollow cylindrical member, the at least one paddle extending from the solid rod being configured to mix the fluid and distribute the heat absorbed by the hollow cylindrical member throughout the fluid as the hollow cylindrical member rotates to enable uniform thermal expansion of the hollow cylindrical member in the nip.

8. The pressure roller of claim 7, the exterior surface of the solid rod further comprising:

at least one fin extending from the outer surface of the solid rod, the at least one fin being configured to mix the fluid and distribute the heat absorbed by the hollow cylindrical member within the chamber to enable uniform thermal expansion of the hollow cylindrical member in the nip.

9. The pressure roller of claim 7 wherein the hollow cylindrical member is substantially comprised of stainless steel.

10. The pressure roller of claim 7 wherein the elastomeric layer is substantially comprised of polyurethane.

11. The pressure roller of claim 7 wherein an outer diameter of the elastomeric layer at the first and second ends of the hollow cylindrical member is less than an outer diameter of the elastomeric layer at a center portion of the hollow cylindrical member.

12. The pressure roller of claim 7, the outer surface of the elastomeric layer being configured to contact the other roller under pressure to form the nip.

13. A printing machine comprising:

a first roller;

a second roller including:

a hollow cylindrical member having a first end, a second end, an inner cylindrical wall, and an outer cylindrical wall, the inner cylindrical wall forming a chamber that extends between diametrically opposed portions of the inner cylindrical wall around an entire circumference of the inner cylindrical wall and that extends from the first end to the second end of the hollow cylindrical member;

an elastomeric layer connected immediately adjacent to the outer cylindrical wall, surrounding the outer cylindrical wall from the first end to the second end of the hollow cylindrical member;

a first endbell sealingly connected to the first end of the hollow cylindrical member;

a second endbell sealingly connected to the second end of the hollow cylindrical member, the first endbell and the second endbell preventing ingress and egress of fluid from the chamber within the hollow cylindrical member of the second roller;

a volume of a fluid within the chamber that fills no more than ninety-five percent of the chamber to absorb heat transferred to the hollow cylindrical member by the first roller that forms a nip with the elastomeric layer of the second roller and to distribute the heat absorbed from the first roller throughout the fluid as the hollow cylindrical member rotates to enable uniform thermal expansion of the hollow cylindrical member in the nip; and at least one paddle extending from the inner cylindrical wall of the hollow cylindrical member, the at least one paddle being configured to mix fluid and distribute heat absorbed by the hollow cylindrical member within the chamber to enable uniform thermal expansion of the hollow cylindrical member in the nip;

a plurality of printheads configured to eject ink drops onto a media web; and a media transport configured to move the media web through the nip after the ink drops have been ejected onto the media web to spread the ink drops and form an ink image on the media web.

14. The printing machine of claim 13, the second roller further comprising:

at least one fin extending from the inner cylindrical wall, the at least one fine being configured to mix the fluid and distribute the heat absorbed by the hollow cylindrical member within the chamber to enable uniform thermal expansion of the hollow cylindrical member in the nip.

15. The printing machine of claim 13 wherein the hollow cylindrical member is substantially comprised of stainless steel.

16. The printing machine of claim 13 wherein the elastomeric layer is substantially comprised of polyurethane.

17. The printing machine of claim 13 wherein an outer diameter of the elastomeric layer at the first and second ends of the hollow cylindrical member is less than an outer diameter of the elastomeric layer at a center portion of the hollow cylindrical member.

* * * * *